United States Patent [19]

Erdmann

[11] 4,158,912

[45] Jun. 26, 1979

[54] CANDLE DIAMETER REDUCER

[75] Inventor: Hein W. Erdmann, 59 Foster Rd., Belmont, Mass. 02178

[73] Assignee: Hein Werner Erdmann, Belmont, Mass.

[21] Appl. No.: 850,412

[22] Filed: Nov. 10, 1977

[51] Int. Cl.[2] ..... B26B 11/00

[52] U.S. Cl. ..... 30/124; 145/3.31

[58] Field of Search ..... 145/3.1, 3.3, 3.31, 145/3.5, 27; 30/124, 115

[56] References Cited

U.S. PATENT DOCUMENTS

| | | | |
|---|---|---|---|
| 1,154,325 | 9/1915 | La Casse | 145/3.3 X |
| 1,486,007 | 3/1924 | Beice | 145/3.5 X |
| 1,647,078 | 10/1927 | Brown | 145/3.5 |
| 1,833,926 | 12/1931 | Anthony | 145/3.5 X |
| 2,691,960 | 10/1954 | Leeds | 145/3.31 |

*Primary Examiner*—Jimmy C. Peters

[57] ABSTRACT

A tool for chamfering an end of a candle, so that it fits into a candle holder having a smaller diameter opening than the original diameter of the candle; the tool including a tapered hole, into which the end of the candle is fitted, and a cutting blade being along one side edge of an elongated slot along one side of the tapered hole.

2 Claims, 6 Drawing Figures

10
11
12
13
14
15
16
17
18
19
20
21
22
23
24
30
31
32
33
34
35
36
37
38
39
40
41
42
3
4

CANDLE DIAMETER REDUCER

This invention relates generally to sharpening tools.

It is generally well known, that, upon occasion, a person may wish to fit a larger size of candle into a candle holder having an undersized receptacle opening.

Accordingly, it is the principal object of the present invention to provide a candle diameter reducer, whereby a lower end of a candle can be chamfered, so that it can be fitted into a candle holder having an insufficient diameter opening so as to receive a large candle.

Another object of the present invention is to provide a candle diameter reducer, which is adaptable to taper candles of various diameters, and which may be made suitable so as to handle candles from one eighth of an inch up to two or three inches in diameter.

Yet another object of the present invention is to provide a candle diameter reducer, which, in a modified design thereof, can chamfer various angles of taper, as wished.

Yet a further object is to provide a candle diameter reducer, which, in a modified design of the invention, also includes a receptacle for catching wax that is shaved off the candle.

Other objects are to provide a candle diameter reducer, which is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4, 5, 6:
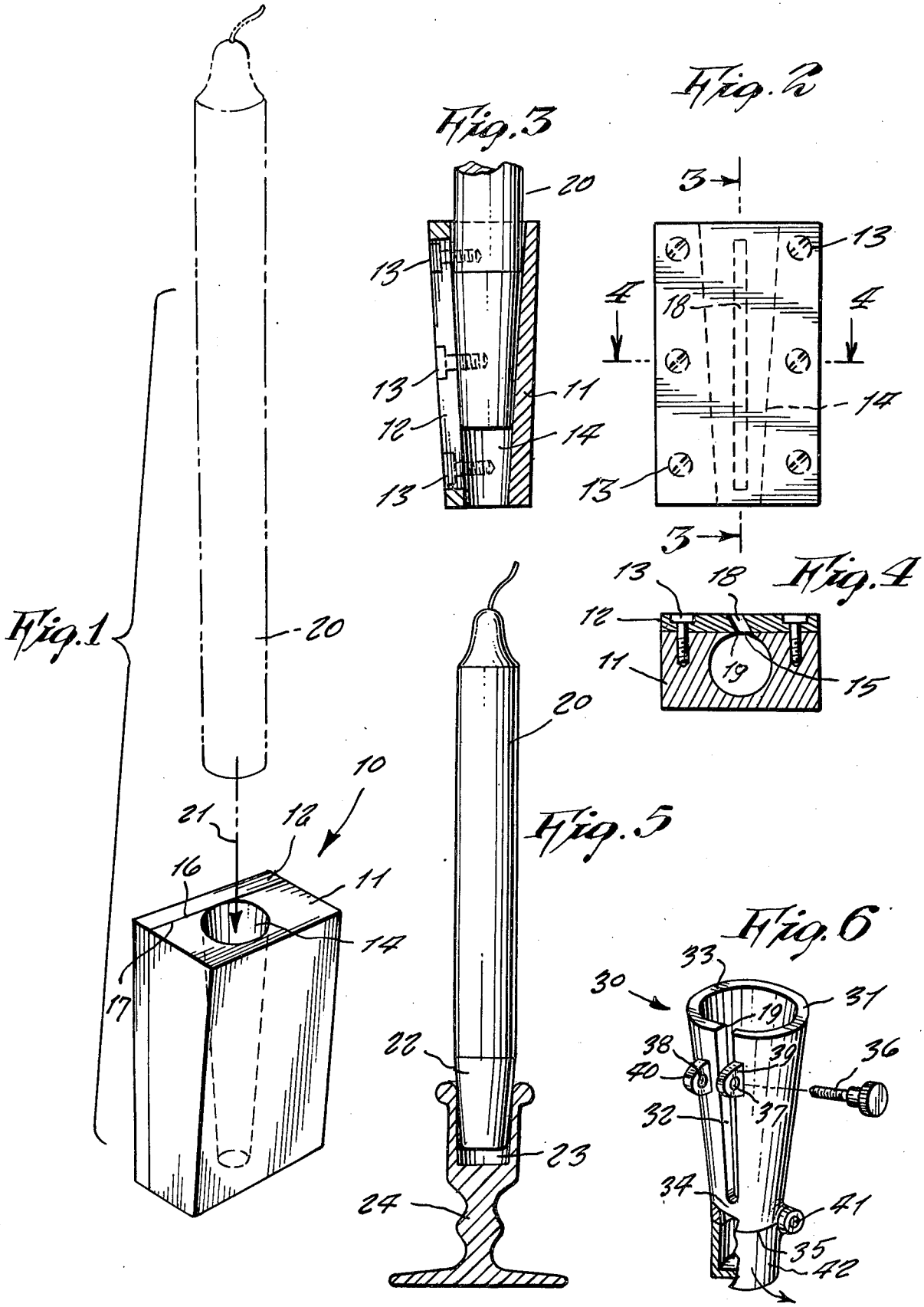
FIG. 1 is a perspective view of the present invention, shown in relation to a candle ready to be inserted thereinto.
FIG. 2 is a side elevation view thereof.
FIG. 3 is a cross-sectional view, taken on line 3—3 of FIG. 2.
FIG. 4 is a transverse cross-sectional view, taken on line 4—4 of FIG. 2.
FIG. 5 is a side view of a candle, after being chamfered by the candle diameter reducer, and shown being inserted into a candle-stick, having an undersized receptacle opening.
FIG. 6 is a perspective view of a modified design of the invention.

Referring now to the drawing in greater detail, and more particularly, to FIGS. 1 through 5 thereof, at this time, the reference numeral 10 represents a candle diameter reducer, according to the present invention, wherein the same is comprised of two plexiglass components 11 and 12, that are secured together by means of screws 13. The component 11 includes a tapered opening 14, extending therethrough, the opening being positioned so that it has a slit 15, extending the entire length of the opening, due to the opening communicating its entire length with the side wall 16 of the component 11.

The component 12 includes a flat side 17, which abuts against the side 16 of component 11, as shown in FIGS. 1 and 4, the component 12 having an elongated slot 18, extending nearly the entire length of the component 12. The slot 18 is made at an inclined angle, so as to produce an acute angled edge 19, which serves as a cutting blade for nearly the entire length of the tapered opening.

In operative use, a lower end of a large diameter candle 20 is inserted into the wide diameter end of opening 14, and is rotated respective to the candle diameter reducer, while, at the same time, being urged into the direction as indicated by arrow 21, thus resulting in the lower end of the candle being shaved by the cutting edge 19. The lower end of the candle is thus chamfered, as shown at 22 in FIG. 5, so that it will be readily able to fit within a smaller diameter opening 23 of a candle holder 24. Thus, the present candle diameter reducer readily adapts large diameter candles for candle-sticks having undersized receptacle openings.

Referring now to FIG. 6 of the drawing, there is shown a modified design of candle diameter reducer 30, in which there is a conically shaped shell 31, made of a resilient plastic material. An elongated slot 32 extends from an upper edge 33 of the shell, and nearly to a lower end thereof, except for a narrow bridge portion 34, between a lower end of the slot 32, and a lower edge 35 of the shell. In this design, due to the flexible material of the conical shape, the upper end of the shell can be diametrically expanded or contracted, in order to change an angle of a taper being cut into a candle. Thus, while the upper end of the shell is expandable or contractable, the lower end thereof is fixed. The upper end of the shell can be selectively secured at a specific size of diameter, by means of a screw 36, being receivable through a clearance opening 37, and a threaded opening 38 of lugs 39 and 40, located on opposite side edges of the slot 32.

A lower end of the shell is connected, by means of a hinge 41, to a receptacle 32, and which serves to catch candle shavings, so as to prevent such shavings from being scattered upon a floor or carpet, where such wax shavings might become stuck, and become hard to remove. Accordingly, such receptacle will allow the operation to be neat, and not messy. In operative use, the receptacle is pivoted into the position underneath the shell, as shown in FIG. 6, in order to catch the shavings. After the operation is completed, the receptacle can be easily dumped out, by simply pivoting the receptacle about the hinge, in order to dump out the shavings.

Thus, a modified design has been presented.

While various changes may be made in the detail construction, it is understood that such changes will be within the spirit and scope of the present invention, as is defined by the appended claims.

What I now claim is:

1. A candle diameter reducer, comprising, in combination, a sharpening tool for cutting a chamfer at a lower end of a candle, said candle diameter reducer including a conically tapered opening, into a wide end of which said candle is inserted and rotated, said conical opening having a longitudinally extending slit along a side thereof, so that a cutting edge of a blade chamfers said candle; said candle diameter reducer comprising a conically tapered shell of resilient material, said slit extending from a wider diameter edge of said shell, and nearly to an opposite end thereof, said slit having one longitudinal edge thereof protruding inwardly into said conical opening, so as to form said cutting blade edge, and means whereby a tapered angle of such shell is selectively adjustable.

2. The combination as set forth in claim 1, wherein a receptacle is pivotally secured to a lower open end of said shell.

* * * * *